US005592119A

United States Patent [19]

Yoo

[11] Patent Number: 5,592,119

[45] Date of Patent: Jan. 7, 1997

[54] HALF POWER SUPPLY VOLTAGE GENERATING CIRCUIT FOR A SEMICONDUCTOR DEVICE

[75] Inventor: Seung-Moon Yoo, Kyungki-do, Rep. of Korea

[73] Assignee: Samsung Electronics Co., Ltd., Suwon, Rep. of Korea

[21] Appl. No.: 224,019

[22] Filed: Apr. 7, 1994

[30] Foreign Application Priority Data

Apr. 16, 1993 [KR] Rep. of Korea ..... 1993-6412

[51] Int. Cl.[6] ..... G05F 1/10

[52] U.S. Cl. ..... 327/530; 327/535; 327/538

[58] Field of Search ..... 307/296.1, 296.2, 307/296.4, 296.5, 296.6, 296.8, 572; 365/189.09, 228; 327/530, 535, 538, 543, 537, 434, 427

[56] References Cited

U.S. PATENT DOCUMENTS

| | | | |
|---|---|---|---|
| 3,914,702 | 10/1975 | Gehweiler | 307/296.8 |
| 4,663,584 | 5/1987 | Okada et al. . | |
| 4,812,735 | 3/1989 | Sawada et al. | 307/296.8 |
| 5,172,013 | 12/1992 | Matsumura | 307/296.1 |

*Primary Examiner*—Timothy P. Callahan
*Assistant Examiner*—Jung Ho Kim

[57] ABSTRACT

A half power supply voltage generating circuit receiving first and second power supply voltages and comprising; a bias circuit for generating first and second reference voltages in response to the first and second power supply voltages, and a driver circuit receiving the first and second reference voltages and generating a half power supply voltage, the driver circuit comprising four MOS transistors connected in series between the first and second supply voltages.

9 Claims, 3 Drawing Sheets

HALF POWER SUPPLY VOLTAGE GENERATING CIRCUIT FOR A SEMICONDUCTOR DEVICE

BACKGROUND OF THE INVENTION

The present invention relates to a constant voltage generating circuit for a semiconductor device. More particularly, the present invention relates to a circuit which generates a constant voltage at a level stabilized between two power supply voltages, and which finds application in semiconductor memory devices.

Increased integration of semiconductor memory devices has resulted in unit memory cells of extremely small size. Along with the sharp reduction in physical size, memory cells in highly integrated semiconductor memory devices also require a reduced operating voltage, that is, a reduced supply voltage Vcc. Past requirements for stable semiconductor operating voltages have been meet by well known constant voltage generating circuits. These well known constant voltage generating circuits include; the substrate voltage generating circuit, the reference voltage generating circuit, and the half power supply voltage generating circuit (hereinafter"half Vcc generating circuit"). Of these, the half Vcc generating circuit has found particular application in precharging bit lines and/or data lines in semiconductor memory devices. In fact, the need for stable, efficient half Vcc generating circuits continues to expand with the increased demands of next generation semiconductor memory devices.

This expanding need was originally addressed in U.S. Pat. No. 4,663,584. This patent discloses a half Vcc generating circuit, shown for example in FIG. 1, which is readily implemented in CMOS logic. As can be seen in FIG. 1, the half Vcc generating circuit comprises a bias circuit 40, and driver circuit 50. Bias circuit 40 generates first and second reference voltages in accordance with the voltage difference between power supply voltages Vcc and Vss. Driver circuit 50 generates half power supply voltage (Vm) in accordance with the first and second reference voltages.

Bias circuit 40 comprises p-channel MOS transistor Q5, n-channel MOS transistor Q1, p-channel MOS transistor Q2, and n-channel MOS transistor Q6 which are serially connected between a first power supply voltage Vcc and a second power supply voltage Vss. The gate of Q5 is connected to Vss along with the source of Q6. The source of Q5 is connected to Vcc along with the gate of Q6. The gate and drain of Q1, as well as the drain of Q5 are commonly connected to a first voltage node n1 at which the first reference voltage is apparent. The source of Q2 and the source of Q1 are commonly connected at a third voltage node n3, The gate and drain of Q2, as well as the drain of Q6 are commonly connected to a second voltage node n2 at which the second reference voltage is apparent.

Driver circuit 50 comprises n-channel transistor Q3, and p-channel transistor Q4 serially connected between Vcc and Vss. The gate of Q3 receives the first reference voltage from node n1, and the gate of Q4 receives the second reference voltage from node n2. The drain of Q3 is connected to Vcc, and the drain of Q4 is connected to Vss. Finally, the source of Q3 and the source of Q4 are commonly connected at node n4 at which the half power supply voltage Vm is apparent.

In operation, the voltage at node n1 becomes ½ Vcc+$V_{TQ1}$, wherein $V_{TQ1}$ equals the threshold voltage of Q1, when node n3 is equal to ½ Vcc. Similarly, the voltage at node n2 becomes ½ Vcc+$V_{TQ2}$, wherein $V_{TQ2}$ equals the threshold voltage of Q2, when node n3 is equal to ½ Vcc. If, under these conditions, Vm is lower than the voltage at node n1, then Q3 is slightly turned ON, thereby increasing the voltage at node n4. On the other hand, if Vm is higher than the voltage at node n2, then Q4 slightly turned ON, thereby decreasing the voltage at node n4. As a result, Vm is precisely adjusted to ½ Vcc.

The above described conventional half power supply generating circuit operates very well, until such time as Vm falls below a predetermined level. When Vm falls below this predetermined level, because, for example, of an abrupt current drain brought about by transient loading, Vm is very slow to recover. Slow Vm recovery precludes (or limits) high-speed operation of a semiconductor memory device incorporating the above conventional circuit.

Another conventional half power supply voltage generating circuit which addresses the problem described above is shown in FIG. 2. This second conventional circuit is used by Matsushita in its 4 Mbit dynamic RAM. The bias circuit 41 of the second conventional circuit differs from the bias circuit 40 of the first conventional circuit in the connection of transistors Q5 and Q6. In the circuit shown in FIG. 1, Q5 and Q6 were always ON. However, in the circuit shown in FIG. 2, Q5 and Q6 are controlled by the output of the half power supply voltage Vm apparent at node n4. This feature allows better Vm recovery time and, thus, better start-up and high-speed operation.

The operation of the second conventional circuit will now be described with reference to FIG. 2 and to FIG. 5. The unevenly dotted line in FIG. 5 illustrates the voltage-current characteristic curve for the circuit shown in Fig. 2. In the circuit shown in FIG. 2, as the voltage at node n1 rises above the threshold voltage VTQ3, due to an increase in the level of Vcc, Q3 is turned ON, thereby increasing the voltage at node n4. See, for example, Vcc1 in FIG. 5. As Vcc continues to increase to Vcc2, but the voltage at node n1 remains lower than the sum of the threshold voltages $V_{TQ1}$+$V_{TQ2}$, the bias circuit 41 does not "set up." Under these circumstances, if Vm is greater than $V_{TQ6}$, then Q6 is turned ON and node n2 goes to Vss, thereby also turning Q4 ON.

In other words, transistors Q3 and Q4 are both turned ON for some time period preceding the "set up" of the bias circuit 41. This creates direct current path between Vcc and Vss in the driver circuit. This also results in node n1 having a voltage level equal to Vcc and node n2 having a voltage level equal to Vss. The resulting current flow is shown by the evenly dotted line in FIG. 5.

As Vcc is increased upward through Vcc3 to Vcc4, transistors Q1 and Q2 are operated in a diode fashion within the bias circuit 41 to adjust the voltages at nodes n1 and n2. The voltage at node n2 moves from Vss to a DC level determined by the channel resistances of Q5, Q1, Q2, and Q6. Meanwhile, the voltage at node n1 also assumes a DC level between Vcc and Vss. These voltage node adjustments cause the gate-source voltages of Q4 and Q3 ($V_{GSQ4}$, $V_{GSQ3}$) to decrease, thereby reducing current flow between Q3 and Q4. Since current flows through the bias circuit 41, the current in the driver section 51 is reduced. This result is shown in FIG. 5 between power supply voltage of Vcc3 and Vcc4.

Finally, as Vcc is increased to completely set up the bias circuit 41, node n1 moves to ½ Vcc+$V_{TQ1}$, and node n2 moves to ½ Vcc−$V_{TQ2}$, such that Q3 and Q4 are slightly turned ON. In response, current flow through Q3 and Q4 is drastically reduced, and direct current flows through the bias circuit 41. See FIG. 5 for Vcc exceeding Vcc4.

Unfortunately, while addressing the Vm recovery problem associated with the first conventional half Vcc generating circuit, the second conventional circuit shown in FIG. 2 suffers from several other problems. Among these problems is excessive power consumption. This is primarily the result of the "short-circuit" current flow in the driver section 51 during the rise of Vcc from Vcc2 to Vcc4 in FIG. 5. Excessive power consumption is particularly prevalent for low Vcc voltage levels. Additionally, since Vcc and Vss are directly connected to the drains of Q3 and Q4 respectively, it is difficult to protect the conventional half Vcc generating circuit from electrostatic discharge.

SUMMARY OF THE INVENTION

The present invention solves these problems, and addresses other shortcomings within the prior art by providing a half Vcc generating circuit capable of safe and reliable operation at low Vcc voltage levels. More particularly, the present invention provides a half Vcc generating circuit which operates reliably at reduced power consumption levels. The present invention conserves power even when operating at low Vcc voltage levels. The present invention also suppresses excessive direct current flows through the driver section of the half Vcc generating circuit. Finally, the present invention provides a half Vcc generating circuit with improved immunity to electrostatic discharge.

The present invention accomplishes the foregoing by providing a half power supply voltage generating circuit receiving first and second power supply voltages and comprising; a bias circuit receiving the first and second power supply voltages and generating first and second reference voltages in response to the first and second power supply voltages, and a driver circuit receiving the first and second power supply voltages and the first and second reference voltages, and generating a half power supply voltage at a half power supply voltage node, the driver circuit comprising; a first MOS transistor of first conductivity type having a first source connected to the first power supply voltage, a first gate connected to the half power supply voltage node, and a first drain, a second MOS transistor of second conductivity type having a second source connected to the half power supply voltage node, a second gate connected to the first reference voltage, and a second drain connected to the first drain, a third MOS transistor of first conductivity type having a third source connected to the half power supply voltage node, a third gate connected to the second reference voltage, and a third drain, and a fourth MOS transistor of second conductivity type having a fourth source connected to the second power supply voltage, a fourth gate connected to the half power supply voltage node, and a fourth drain connected to the third drain.

BRIEF DESCRIPTION OF THE DRAWINGS

The above described benefits and other advantages of the present invention will become more apparent upon consideration of a preferred embodiments of the present invention with reference to the attached drawings. In the drawings, like elements are similarly designated with like reference numerals, wherein.

DETAILED DESCRIPTION OF THE INVENTION

Figure 1:
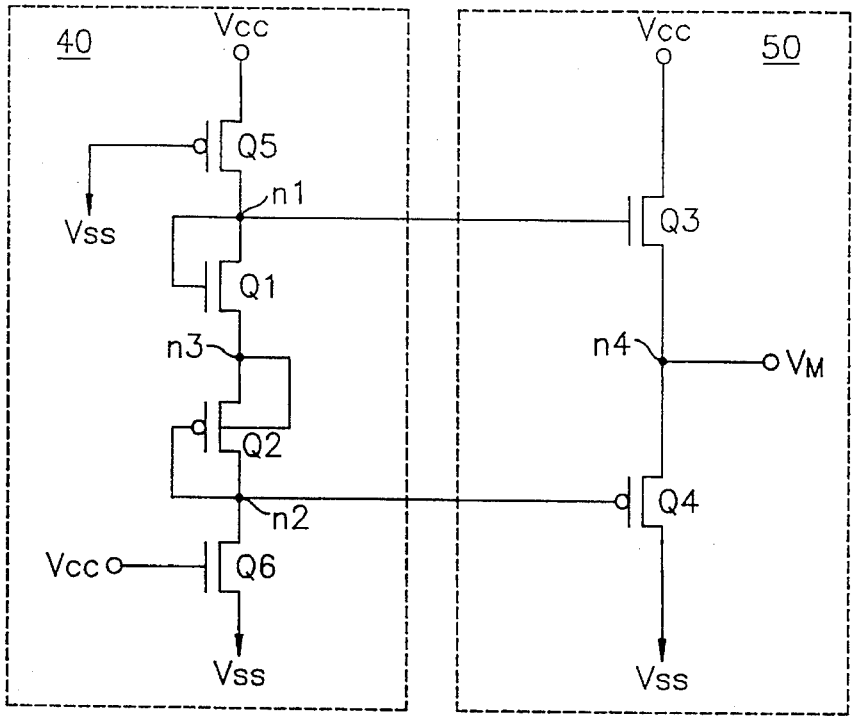
(PRIOR ART) FIG. 1
FIG. 1 is a circuit diagram of a first conventional half Vcc generating circuit.
Figure 2:
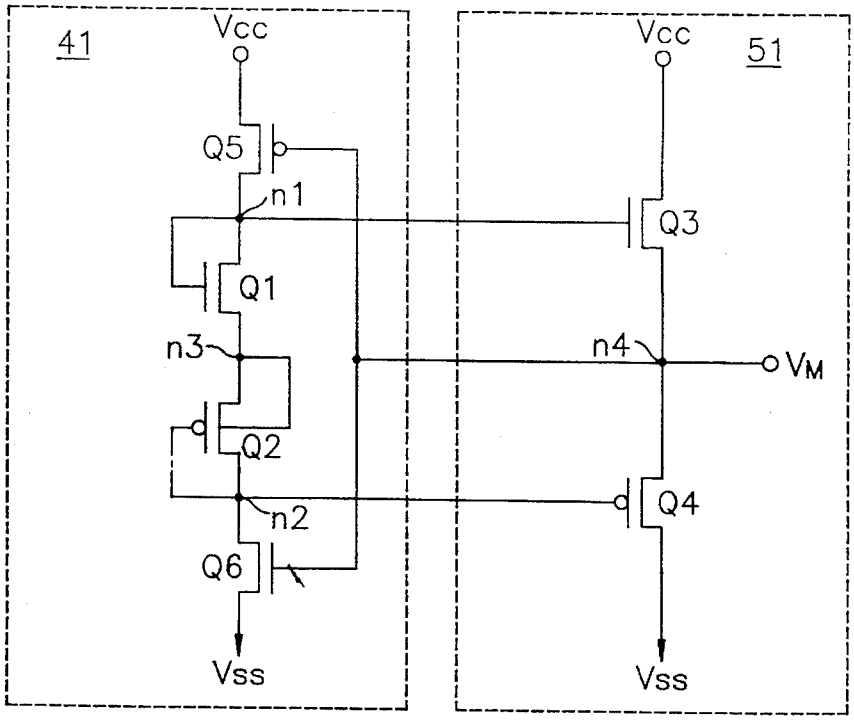
(PRIOR ART) FIG. 2
FIG. 2 is a circuit diagram of a second conventional half Vcc generating circuit.
Figure 3:
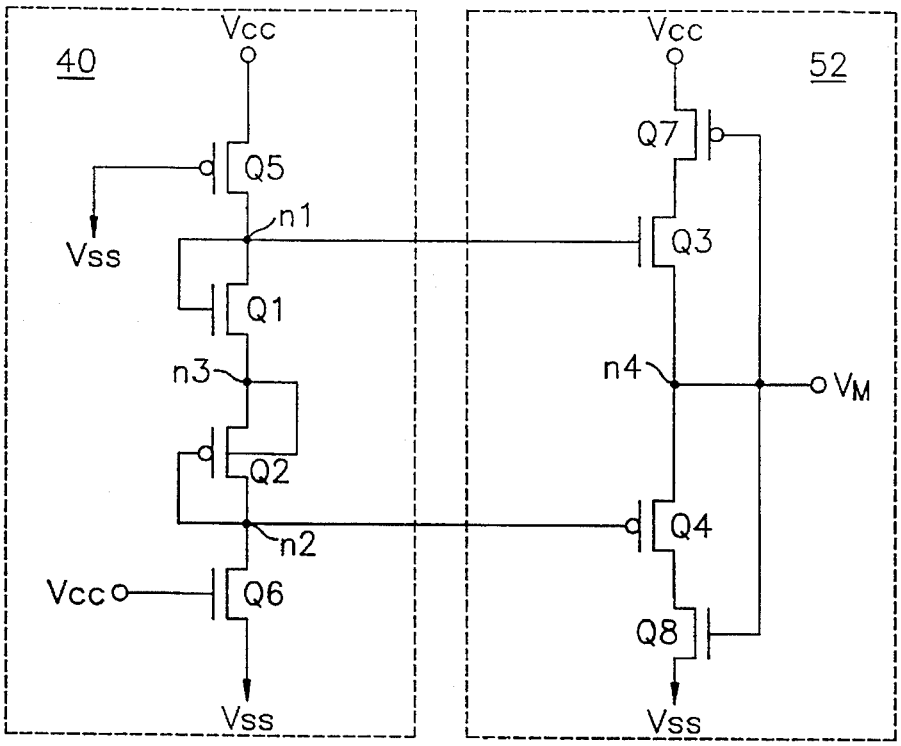
FIG. 3 is a circuit diagram of a half Vcc generating circuit according to a first embodiment of the present invention.

A first preferred embodiment of the present invention shown, for example, in FIG. 3 comprises a bias circuit 40 and a driver circuit 52. As previously described, bias circuit 40 generates first and second reference voltages in accordance with the voltage difference between Vcc and Vss. Driver section 52 generates half power supply voltage Vm.

Driver circuit 52 comprises transistors p-channel transistor Q7, n-channel transistor Q3, p-channel transistor Q4, and n-channel transistor Q8 connected in series between Vcc and Vss. In particular, the source of Q7 is connected to Vcc, and the source of Q8 is connect to vss. The gate of Q3 and the gate of Q4 are, as previously described, connected to nodes n1 and n2 of the bias circuit 40, respectively. Also, as previously described, the commonly connected sources of Q3 and Q4 form node n4 at which Vm is apparent. However, in an embodiment of the present invention, node n4 is also connected to the respective gates of Q7 and Q8. Finally, the drain of Q7 is connected to the drain of Q3, and drain of Q8 is connected to the drain of Q4.

An explanation of the operation of the foregoing half Vcc generating circuit will be given with reference to FIG. 5. Since Q5 is normally turned ON, and if Vcc is increased above the $V_{TQ3}$, then the voltage level at node n4 will rise. Once the voltage level at node n4 rises to a level sufficient to turn Q8 ON, then a direct current path is formed through Q7, Q3, Q4, and Q8. However, although the bias circuit 40 has not been set up, the direct current through this path is not nearly as large as that in the conventional circuits, since the transistors directly connected to Vcc and Vss are controlled by Vm. In fact, a exemplary voltage-current characteristic curve for the present invention is shown by the solid line in FIG. 5.

After the point at which Q8 is turned ON, bias circuit 40 is set up and the limited direct current flowing through the driver circuit 52 is shunted off to the direct circuit path set up in the bias circuit 40. As a result, excessive current flow is prevented and power is conserved. Furthermore, the connections of Q7 with Q3 and Q8 with Q4 protect the circuit from electrostatic discharge.

Figure 4:
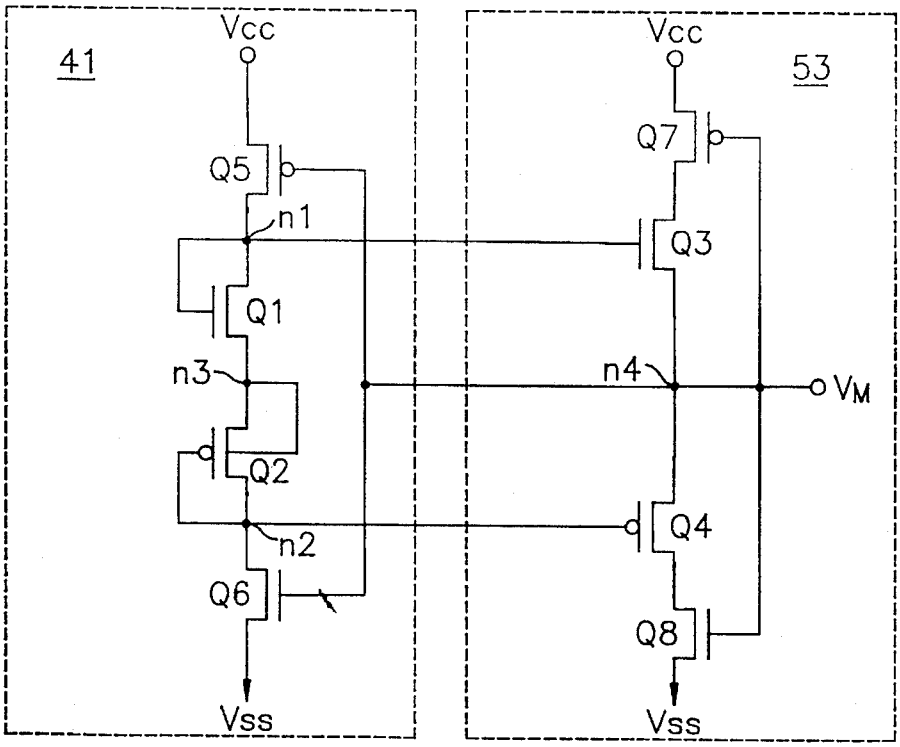
FIG. 4 is a circuit diagram of a half Vcc generating circuit according to a first embodiment of the second embodiment of the present invention, for example.

FIG. 4 shows another embodiment of the present invention comprising bias circuit 41 and driver circuit 53. In driver circuit 41, the gates of Q5 and Q6 are connected to Vm, rather than to Vss and Vcc, respectively. Except for the connection of Vm, driver circuit 53 is identical to that of driver circuit 52.

In operation, the half Vcc generating circuit of FIG. 4 enjoys excellent Vm recovery. For example, where the level of Vm is less than an initial level, the gate voltages of Q5 and Q7 rise, thus causing an even greater rise in the gate and drain voltages of Q3. Accordingly, current flow through Q3 is increased and the level of Vm rises to its initial level. Conversely, where the level of Vm is greater than the initial level, the combined action of Q6 and Q8 drive Vm back towards it initial level.

Figure 5:
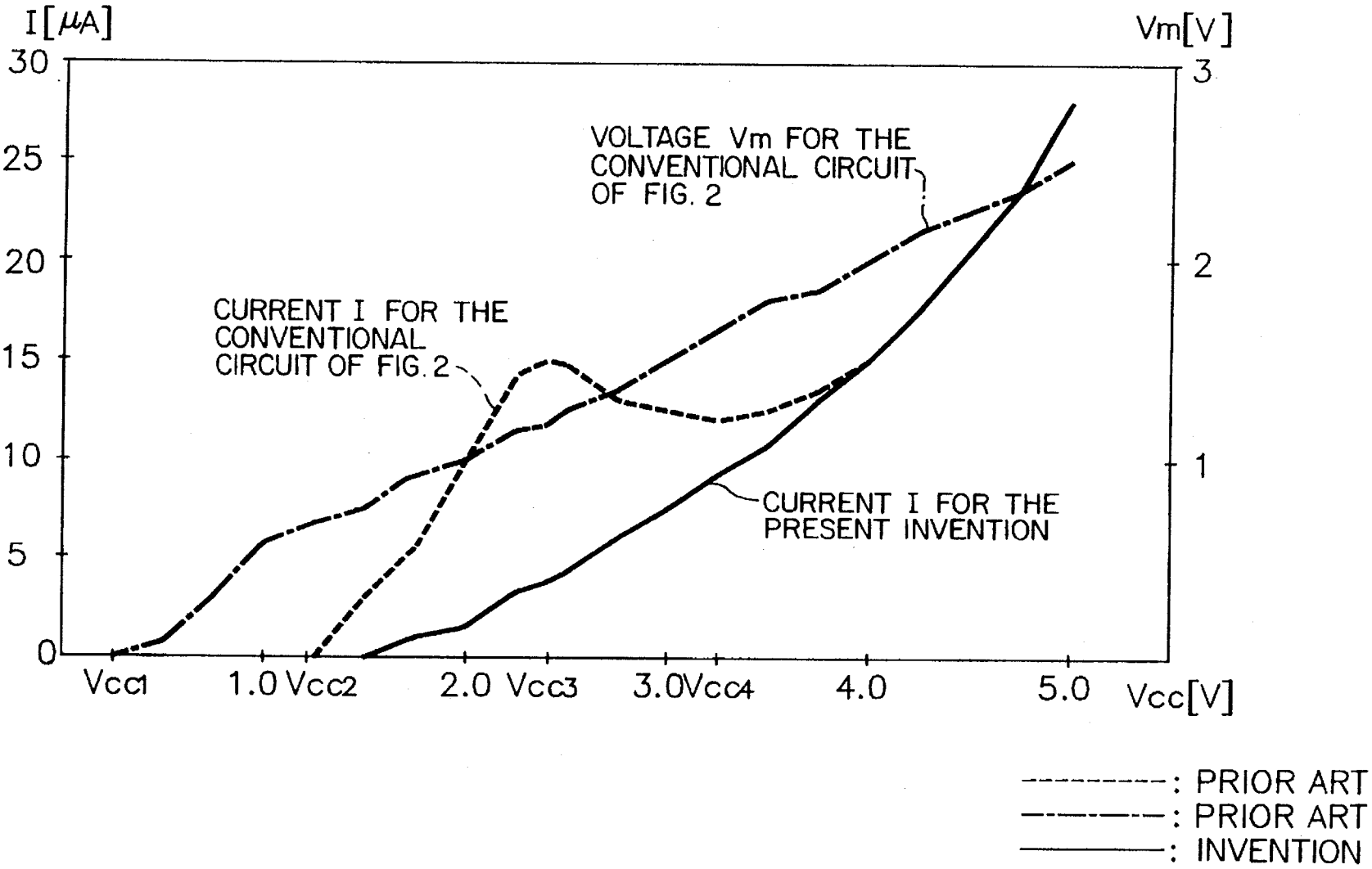
FIG. 5 is a graph illustrating the relative voltage-current characteristic curves for the second conventional half Vcc generating circuit, and the half Vcc generating circuit according to the present invention.

As already described, FIG. 5 is a graph illustrating the relative voltage-current characteristic curves for the conventional half Vcc generating circuit and the present invention. Of particular note is the performance of the present invention at low Vcc voltages. As can be seen, the present invention draws considerably less current at lower Vcc voltages, thereby reducing overall power consumption.

Those of ordinary skill in the an will appreciate that the preferred embodiment described above is susceptible to routine design considerations, including circuit modifications and variations. Among the routine design variations contemplated by the present invention is the transposition of p-channel and n-channel MOS devices in the foregoing example. For example, the preferred embodiment couples p-channel MOS transistor Q7 directly to Vcc and n-channel transistor Q8 directly to Vss. However, Q7 might be place, between Q3 and node n4, and Q8 might be placed between Q4 and node n4, thereby coupling Q3 and Q4 directly to Vcc and Vss, respectively. In this configuration, Q7 and Q8 can control or limit current flow through the driver circuit during the set up period for the bias circuit. In sum, the preferred embodiments are given by way of example, and the present invention recited in the attached claims is not limited to these illustrative embodiments

What is claimed is:

1. A half power supply voltage generating circuit receiving first and second power supply voltages and comprising:

a bias circuit receiving said first and second power supply voltages and generating first and second reference voltages in response to said first and second power supply voltages; and a driver circuit receiving said first and second power supply voltages and said first and second reference voltages, and generating a half power supply voltage at a half power supply voltage node, said driver circuit comprising;

a first MOS transistor of first conductivity type having a first source connected to said first power supply voltage, a first gate connected to said half power supply voltage node, and a first drain;

a second MOS transistor of second conductivity type having a second source connected to said half power supply voltage node, a second gate connected to said first reference voltage, and a second drain connected to said first drain;

a third MOS transistor of first conductivity type having a third source connected to said half power supply voltage node, a third gate connected to said second reference voltage, and a third drain; and a fourth MOS transistor of second conductivity type having a fourth source connected to said second power supply voltage, a fourth gate connected to said half power supply voltage node, and a fourth drain connected to said third drain.

2. The half power supply voltage generating circuit of claim 1, wherein said second power supply voltage has a ground potential.

3. The half power supply voltage generating circuit of claim 1, wherein said first conductivity type is p-type and said second conductivity type is n-type.

4. The half power supply voltage generating circuit of claim 1, wherein said bias circuit comprises:

a fifth MOS transistor of first conductivity type having a fifth source connected to said first power supply voltage, a fifth gate connected to said second power supply voltage, and a fifth drain connected to a first voltage node;

a sixth MOS transistor of second conductivity type having a sixth source connected to a third voltage node, a sixth gate and a sixth drain connected to said first voltage node at which said first reference voltage is apparent;

a seventh MOS transistor of first conductivity type having a seventh source connected to said third voltage node, a seventh gate and a seventh drain connected to a second voltage node at which said second reference voltage is apparent; and an eighth MOS transistor of second conductivity type having an eighth source connected to said second power supply voltage, an eighth gate connected to said first power supply voltage, and an eighth drain connected to said second voltage node.

5. The half power supply voltage generating circuit of claim 4, wherein said first conductivity type is p-type and said second conductivity type is n-type.

6. The half power supply voltage generating circuit of claim 4, wherein said second power supply voltage has a ground potential.

7. The half power supply voltage generating circuit of claim 1, wherein said bias circuit comprises:

a fifth MOS transistor of first conductivity type having a fifth source connected to said first power supply voltage, a fifth gate connected to said half power supply voltage node, and a fifth drain connected to a first voltage node;

a sixth MOS transistor of second conductivity type having a sixth source connected to a third voltage node, a sixth gate and a sixth drain connected to said first voltage node at which said first reference voltage is apparent;

a seventh MOS transistor of first conductivity type having a seventh source connected to said third voltage node, a seventh gate and a seventh drain connected to a second voltage node at which said second reference voltage is apparent; and an eighth MOS transistor of second conductivity type having an eighth source connected to said second power supply voltage, an eighth gate connected to said half power supply voltage node, and an eighth drain connected to said second voltage node.

8. The half power supply voltage generating circuit of claim 7, wherein said first conductivity type is p-type and said second conductivity type is n-type.

9. The half power supply voltage generating circuit of claim 7, wherein said second power supply voltage has a ground potential.

* * * * *